US005669162A

United States Patent [19]

Dyer

[11] Patent Number: 5,669,162

[45] Date of Patent: Sep. 23, 1997

[54] CUSHION INSERT

[75] Inventor: Robert M. Dyer, Glendale, Mo.

[73] Assignee: Brown Group, Inc., St. Louis, Mo.

[21] Appl. No.: 611,876

[22] Filed: Mar. 7, 1996

[51] Int. Cl.[6] ..... A43B 13/40; A43B 21/32

[52] U.S. Cl. ..... 36/44; 36/37

[58] Field of Search ..... 36/44, 37, 3 B, 36/43

[56] References Cited

U.S. PATENT DOCUMENTS

| | | | |
|---|---|---|---|
| 2,139,971 | 12/1938 | Pava | 36/141 |
| 2,379,366 | 6/1945 | Lumbard | 36/37 |
| 3,595,244 | 7/1971 | Kugler | 36/141 X |
| 4,075,772 | 2/1978 | Sicurella | 36/141 X |
| 4,435,910 | 3/1984 | Marc | 36/44 |
| 4,586,273 | 5/1986 | Chapnick | 36/44 |
| 4,597,196 | 7/1986 | Brown | 36/44 |
| 4,759,136 | 7/1988 | Stewart et al. | 36/114 |
| 4,776,109 | 10/1988 | Sacre | 36/37 X |
| 4,782,605 | 11/1988 | Chapnick | 36/44 |
| 5,146,698 | 9/1992 | Tilles et al. | 36/44 |
| 5,174,052 | 12/1992 | Schoenhaus et al. | 36/144 |
| 5,488,786 | 2/1996 | Ratay | 36/44 |

FOREIGN PATENT DOCUMENTS

| | | | |
|---|---|---|---|
| 3503960 | 8/1986 | Germany | 36/44 |

*Primary Examiner*—Ted Kavanaugh

*Attorney, Agent, or Firm*—Polster, Lieder, Woodruff & Lucchesi, L.C.

[57] ABSTRACT

A cushion insert to fit inside a shoe of Oxford or boot character to support the foot of a wearer and provide comfort, shock absorption, and stability of foot position in the shoe to retain the optimum position of the foot. The cushion insert is molded of a ethylene vinyl acetate material in which there is an upper surface having a less dense characteristic than a bottom surface.

5 Claims, 3 Drawing Sheets

CUSHION INSERT

BACKGROUND OF THE INVENTION

This invention is directed to a cushion insert for sport and athletic soft sided shoes to provide a necessary degree of stability and support for the foot, as well as to permit the location of shock absorption and lateral and medial alignment of the foot relative to the normal configuration of the shoe.

The closest prior art known to be directed to the problems where the usual soft side athletic shoe has the distinct reaction to adapt its shape to that of the foot of one who wears such a shoe. It is recognized that after a period of use beyond a normal break-in period, the shoe undergoes a change of shape to adapt to any deformity present in the foot. This adaptability of such shoes to make the shoe acquire a comfortable fit forces the shoe to lose its intended support. The structure of the foot is complicated due to the tendency of the many small bones to shift and undergo alignment that is forced by the shape of the foot, rather than to retain the normal configuration and work to retain the foot in its optimum alignment with the leg.

BRIEF SUMMARY OF THE INVENTION

The insert cushion has an important object to control the interior of a shoe so that the anatomical configuration of the interior will retain its original shape to hold the foot substantially as it is intended. When the insert cushion carries out its configurational fit the shoe will acquire a feel of comfort which improves the mobility of the wearer in both walking or in physical activity.

The foregoing and other related features of the invention will be set forth in connection with the drawing disclosure which follows.

DETAIL DESCRIPTION OF THE CUSHION EMBODIMENT

Figure 1:
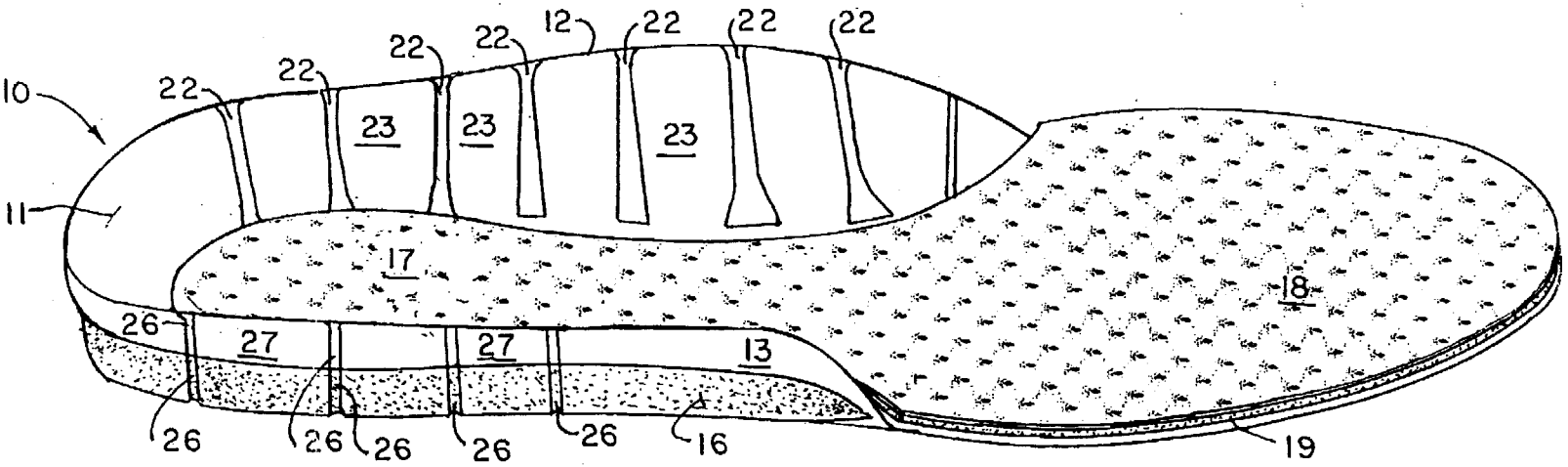
FIG. 1 is a perspective view from the foot receiving side of the insert cushion.
Figure 2:
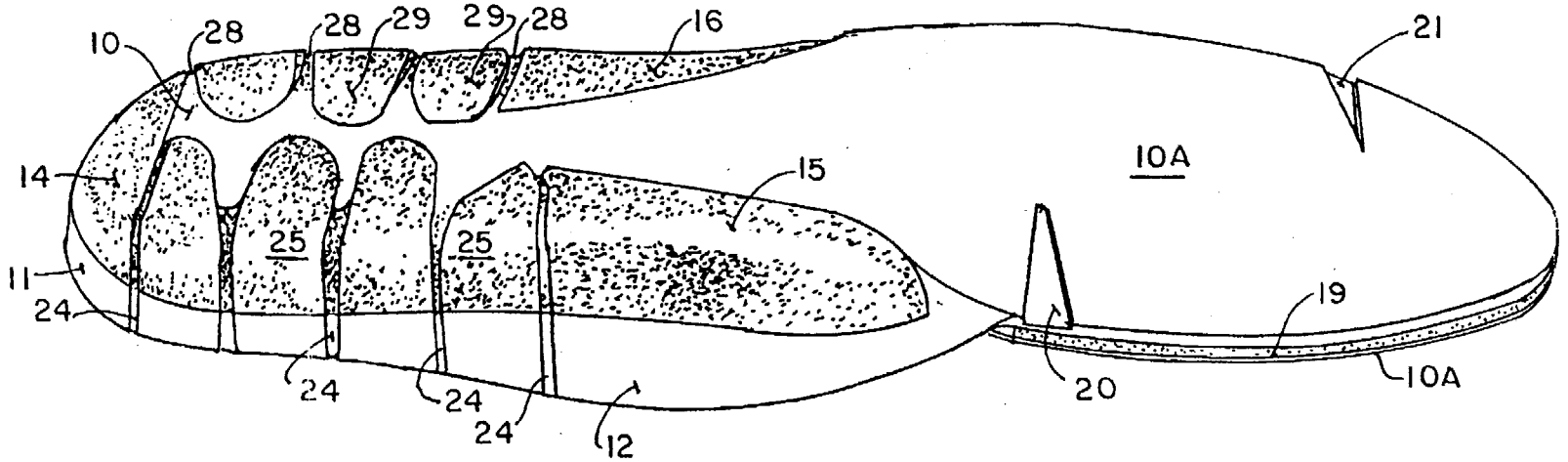
FIG. 2 is a perspective view from the under side of the insert cushion to be received in the interior of a shoe.
Figure 3:
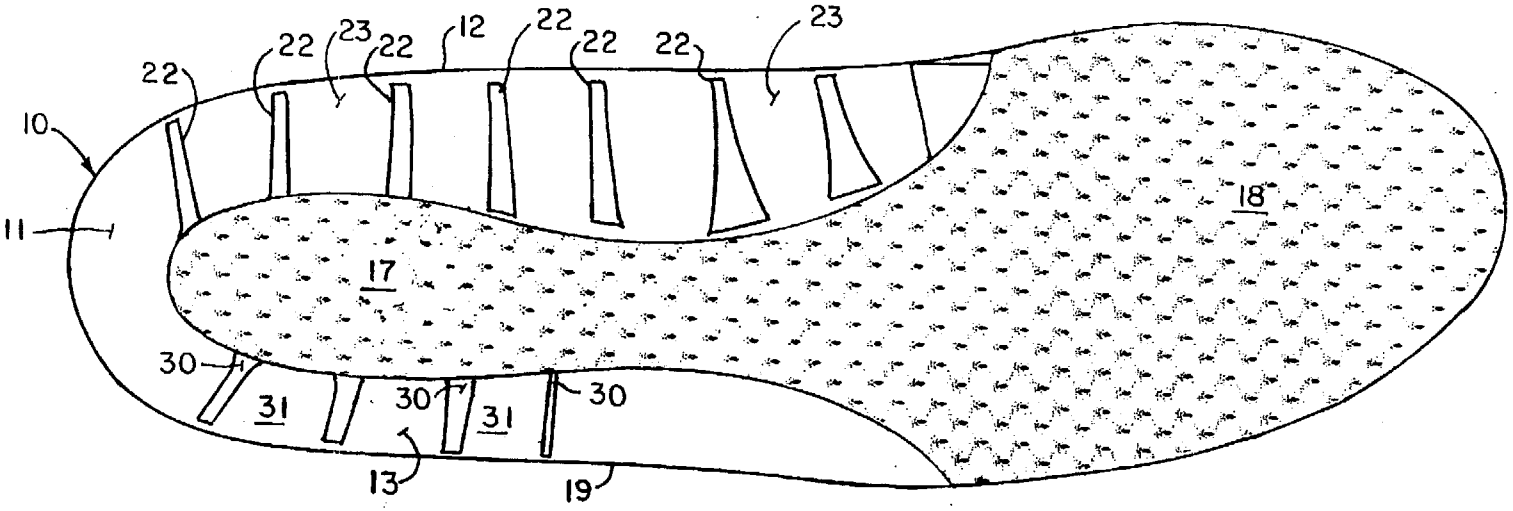
FIG. 3 is a top plan view of the insert cushion with a lining ply in place.
Figure 4:
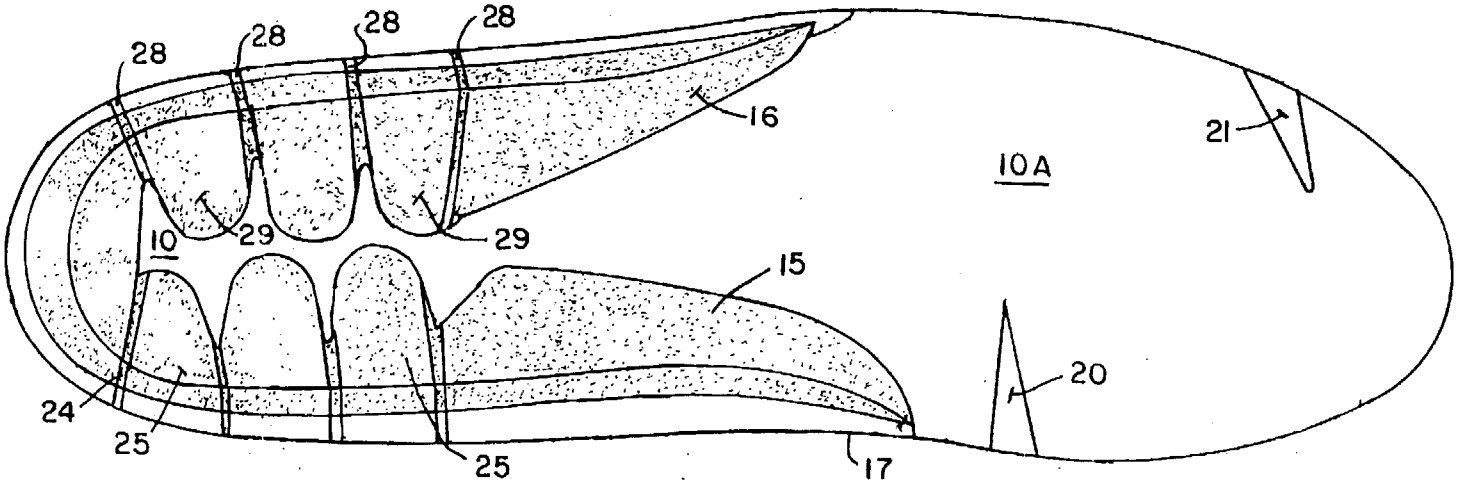
FIG. 4 is a plan view of the bottom or under side of the insert cushion.

A shoe insert cushion 10 is molded into a form that is suitable to provide an inner shoe shaping configuration seen in FIGS. 1 and 3, and an outer shoe fitting configuration in FIGS. 2 and 4. The cushion is selected from elastomeric or ethylene vinyl acetate (EVA) material in which the body 10 has a relatively soft structure. The material of the outer flange structure in the heel and arch areas (shaded area) is a relative hard (EVA) material or thermal plastic urethane (TPU) so it can retain its shape, stabilize and support the heel and arch areas of the soft cushion body 10.

In FIG. 1 there is a one-piece molded body 10 in the shape of a heel cup 11 which has a medial elongated flange 12 and an opposite lateral elongated flange 13. These flange extend into the arch area so the forepart is merely flat. The body 10 is molded from ethylene vinyl acetate (EVA) material that is relatively soft. When the molded body 10 is turned over with its bottom showing, as in FIG. 2, there is a molded formation that is integral with the body 10 but shaped to have an end 14 under the heel cup 11, an elongated flange 15 underlying the medial flange 12, and another elongated flange 16 underlying the lateral flange 13. The preferred embodiment has a body of less dense EVA material than the flanges 15 and 16 (EVA) material.

Returning to FIG. 1, the body 10 has the flanges 12 and 13 embracing an interior liner 17 that extends forward and is aligned over the forepart 18 of the cushion. The liner 17 and forepart 18 are shaped to match an underlying cushion ply 19, while the body 10 has a forepart ply 10A that is shaped to match the cushion ply 19. Flexibility of the ply 10A is improved by the formation of triangular notches 20 and 21.

In order to receive a foot within a shoe and provide that foot with a desired degree of comfort, cushioning and stability, the body 10 is formed along the medial side flange 12 with a series of spaced grooves 22 molded into the flange so the flange can conform to the shoe upper, whether it is a low Oxford or a high-top. Those grooves 22 define the opposite edges of intervening pads 23. When the cushion of FIG. 1 is turned over, as in FIG. 2, the flange 15 is formed with grooves 24 spaced apart to define the opposite edges of an outer surface series of pads 25. The outer pads do not match up in alignment with the inner pads 23 so the flange is further rendered flexible and able to conform to the shape of both the foot and the inner surface of a shoe upper.

In a like manner, the cushion insert 10 of FIG. 1 has its lateral elongated flange 13 formed on its outer surface, as in FIG. 1, with a series of grooves 26 defining the edges of outer pads 27. In FIG. 2, the elongated flange 16 has on its outer bottom surface a series of grooves 28 which define the edges of pads 29.

The structure shown in FIGS. 2 and 4 emphasizes the misalignment of the pads 25 and 29 as those pads extend into the bottom area of the heel. This choice of the staggered alignment of the pads provides a degree of support and stability to the area 17 as seen in FIGS. 1 and 3. At the same time, the structure of the flat forepart 18 or 10A remains flat and of a uniform thickness. The zone of bending of the insert occurs in the zone where the elongated flanges 12 and 13 taper off.

The view of FIG. 3 shows that the inner surface of the elongated lateral flange 16 has a series of spaced grooves 30 which define pads 31. Those inner pads 31 do not register with the pads 29 in the outer surface.

Figure 5:
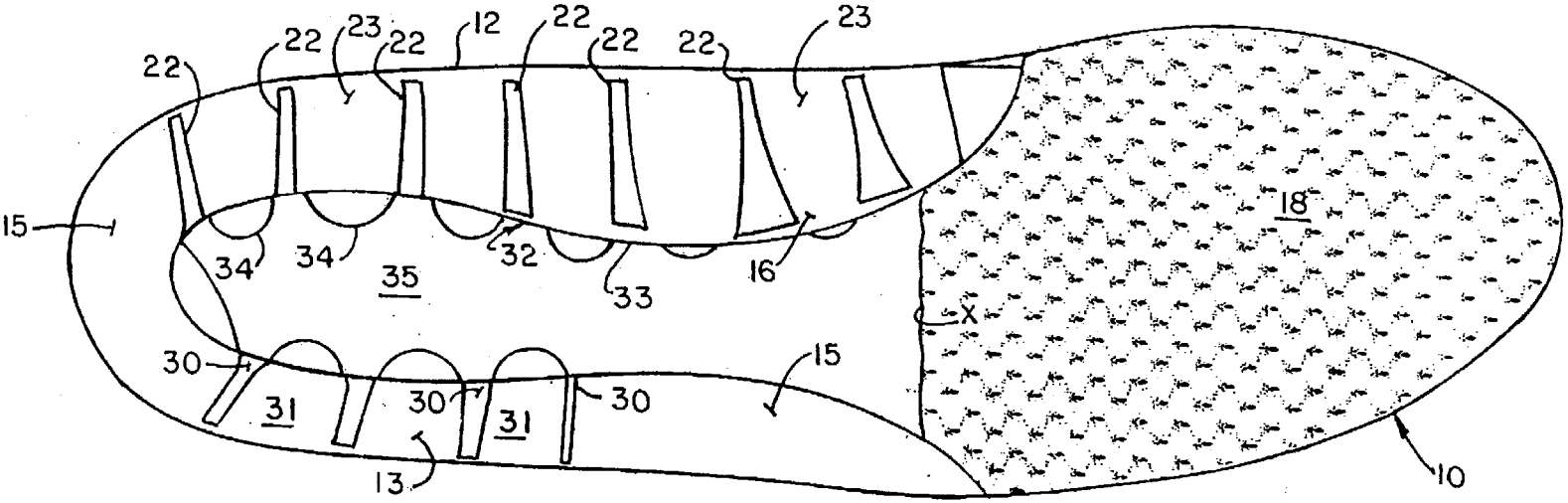
FIG. 5 is a plan view of the interior of the cushion with the lining partly removed to show the cushion pads along the margins of a body recess.

The view of FIG. 5 illustrates a further feature of the construction of the insert cushion 10. Here, when the liner ply 17 is lifted off of the body 10, back to a line X, it reveals that the inner surface of the elongated flanges 12 and 13 define a recess 32 having a margin 33 which is normally abutted by the edge margin of the liner ply 17. During the molding of the body 10, and particularly the pads 23 and 31, the bottom edges have small pad extension 34 which meld into the bottom surface 35 of the recess 32. Those pad extensions on the pads 23 and 31 aid in holding those elongated flanges in the desired alignment in the insert body 10.

Figure 6:
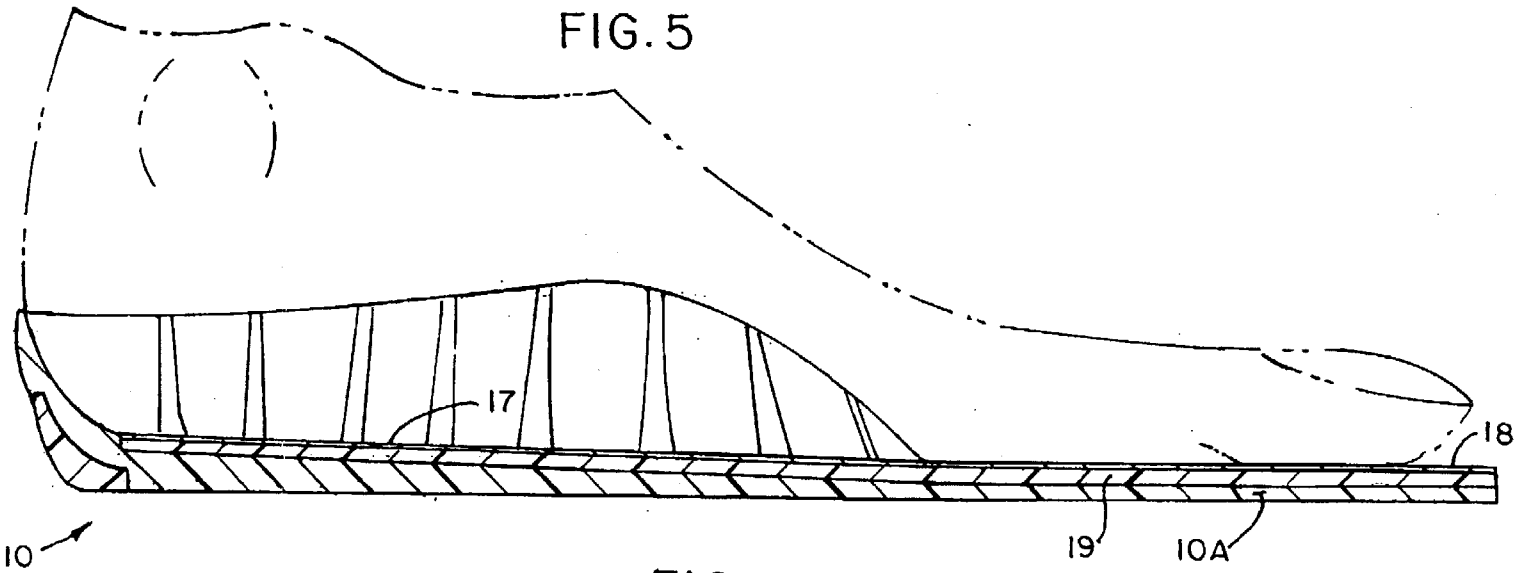
FIG. 6 is a schematic side elevation in section of a foot fitted to a cushion insert.

FIG. 6 is a schematic representation of the position of a foot on the insert cushion before the cushion body 10 is placed inside a shoe. The area of the body 10 under the insert 17 is shown to be thicker than the forepart 10A.

The foregoing detailed description has set forth the preferred embodiment for the cushion insert so that its structural integrity can be maintained to perform its foot position, comfort and stability in a shoe. There are, of course, certain modifications that may arise out of the disclosure herein provided, and those modifications are to be included within the scope of the invention.

What is claimed is:

1. A cushion insert for placement in the interior of a shoe to accommodate the comfort of a foot placed in the interior of a shoe, the cushion insert comprising:

a) a body having an upper foot receiving interior surface characterized by a liner ply flanked by medial and lateral flanges extending from a common heel receiving cup, each of said medial and lateral flanges having spaced apart grooves extending radially inwardly to said liner ply, said grooves defining spaced apart interior pads which render said medial and lateral flanges flexible to conform to a foot received on said liner ply; and b) said body having an applied exterior surface on said medial and lateral flanges with said exterior surfaces having spaced apart grooves defining spaced apart outer pads, with said outer pads being staggered relative to said interior pads.

2. The cushion insert set forth in claim 1 wherein said body interior surface is molded from ethylene vinyl acetate having a soft characteristic.

3. The cushion insert set forth in claim 1 wherein said applied external surface is molded from a hard thermal plastic urethane material.

4. The cushion insert set forth in claim 1 wherein said body interior surface is molded from a soft thermal plastic urethane, and said applied exterior surface is molded from a hard thermal plastic urethane material in position to stabilize and support the areas of said interior pads in said soft interior surface.

5. The cushion insert set forth in claim 1 wherein said interior pads have edges forming pad extensions which mold into said liner ply and aid in holding said medial and lateral flanges in alignment in said insert body.

* * * * *